US008556274B2

(12) United States Patent
Ellis

(10) Patent No.: US 8,556,274 B2
(45) Date of Patent: Oct. 15, 2013

(54) SKATE BRAKE

(76) Inventor: Craig Melvin Ellis, Palos Verdes Estates, CA (US)

( * ) Notice: Subject to any disclaimer, the term of this patent is extended or adjusted under 35 U.S.C. 154(b) by 65 days.

(21) Appl. No.: 13/365,899

(22) Filed: Feb. 3, 2012

(65) Prior Publication Data

US 2013/0200580 A1 Aug. 8, 2013

(51) Int. Cl.
*A63C 17/14* (2006.01)

(52) U.S. Cl.
USPC ..... 280/11.214; 280/11.211; 280/11.216

(58) Field of Classification Search
USPC ..... 280/841, 11.19, 11.201, 11.204, 280/11.208, 11.211, 11.214, 11.215, 280/11.216, 11.217, 11.221, 11.231, 200, 280/210, 11.115, 11.224, 11.225, 11.232, 280/205.1, 206.8, 206
See application file for complete search history.

(56) References Cited

U.S. PATENT DOCUMENTS

| | | | | |
|---|---|---|---|---|
| 1,694,671 | A * | 12/1928 | Rodelli | 188/74 |
| 4,096,651 | A * | 6/1978 | Ancker | 36/117.5 |
| 4,265,462 | A * | 5/1981 | Willi | 280/11.36 |
| 4,275,895 | A | 6/1981 | Edwards | |
| 5,211,409 | A | 5/1993 | Mitchell | |
| 5,232,231 | A | 8/1993 | Carlsmith | |
| 5,253,882 | A | 10/1993 | Mitchell | |
| 5,316,325 | A | 5/1994 | Mitchell | |
| 5,330,207 | A | 7/1994 | Mitchell | |
| 5,374,070 | A | 12/1994 | Pellegrini | |
| 5,388,844 | A | 2/1995 | Pellegrini | |
| 5,397,137 | A | 3/1995 | Pellegrini | |
| D361,814 | S | 8/1995 | Meibock et al. | |
| 5,462,296 | A | 10/1995 | Pozzobon | |
| 5,465,984 | A | 11/1995 | Pellegrini | |
| 5,486,012 | A | 1/1996 | Olivieri | |
| 5,487,552 | A | 1/1996 | Daoust | |
| 5,505,469 | A | 4/1996 | Zorzi et al. | |
| 5,511,804 | A | 4/1996 | Pellegrini | |
| D374,262 | S | 10/1996 | Edauw et al. | |
| 5,564,718 | A | 10/1996 | Mitchell | |
| 5,570,759 | A | 11/1996 | Zorzi | |

(Continued)

FOREIGN PATENT DOCUMENTS

| | | | |
|---|---|---|---|
| AT | 130777 | T | 12/1995 |
| AU | 4601693 | A | 3/1994 |

(Continued)

OTHER PUBLICATIONS http://www.pbkiteboarding.com/Kiteboarding_Snowkiting_Equipment/Skike_Inlline_Skates_Canada_USA/Skike_Inline_Skates_Off_Road_Canada_USA.html, Website, downloaded on Feb. 2, 2012.

(Continued)

*Primary Examiner* — John Walters
*Assistant Examiner* — Brian Swenson
(74) *Attorney, Agent, or Firm* — Marc E. Hankin; Jimmy Sauz; Kevin Schraven

(57) ABSTRACT

A friction brake may be designed to work with either inline or quad skates. The friction brake is adjustable and/or can be made specifically to fit virtually any skate of a skater. The friction brake is preferably comprised of a cuff, one or more compression members, brake frame, brake pad, primary tension member, second tension member, and third tension member. Although the friction brake does not have to include all of the tension members, the friction brake works best when all of the tension members are present.

22 Claims, 11 Drawing Sheets

(56) References Cited

U.S. PATENT DOCUMENTS

| | | | | |
|---|---|---|---|---|
| 5,590,889 | A | 1/1997 | Pozzobon | |
| 5,634,647 | A | 6/1997 | Gorza et al. | |
| 5,647,599 | A | 7/1997 | Visger et al. | |
| 5,649,715 | A | 7/1997 | Mitchell | |
| 5,651,556 | A | 7/1997 | Mitchell | |
| 5,653,454 | A | 8/1997 | Chin | |
| 5,655,783 | A | 8/1997 | Brosnan | |
| 5,664,794 | A | 9/1997 | Mitchell | |
| 5,702,113 | A | 12/1997 | Gonella et al. | |
| 5,704,619 | A | 1/1998 | Mitchell et al. | |
| 5,713,587 | A * | 2/1998 | Morrow et al. | 280/14.21 |
| 5,735,537 | A | 4/1998 | Zorzi | |
| 5,743,540 | A | 4/1998 | Wilhelm, III | |
| 5,755,449 | A | 5/1998 | Pozzobon | |
| 5,794,950 | A | 8/1998 | Svensson et al. | |
| D404,101 | S | 1/1999 | Daoust | |
| 5,860,492 | A | 1/1999 | Talaska | |
| 5,865,445 | A | 2/1999 | Svensson et al. | |
| 5,882,019 | A | 3/1999 | Pellegrini | |
| 5,887,682 | A | 3/1999 | Zorzi et al. | |
| 5,911,423 | A | 6/1999 | Pellegrini | |
| 5,918,888 | A | 7/1999 | Pellegrini | |
| 5,947,487 | A * | 9/1999 | Keleny et al. | 280/11.224 |
| 5,984,323 | A | 11/1999 | Daley | |
| 5,992,862 | A | 11/1999 | Mitchell | |
| 5,997,014 | A | 12/1999 | Ellis et al. | |
| 6,019,379 | A | 2/2000 | DeMarchi | |
| 6,089,579 | A | 7/2000 | Pellegrini | |
| 6,283,481 | B1 | 9/2001 | Roman et al. | |
| 6,425,586 | B1 | 7/2002 | Gorza et al. | |
| 6,431,558 | B1 * | 8/2002 | Erdman | 280/11.19 |
| 6,595,529 | B2 * | 7/2003 | Erdman | 280/11.216 |
| 7,455,305 | B2 * | 11/2008 | Bellehumeur et al. | 280/11.215 |
| 7,926,824 | B2 * | 4/2011 | Quendez | 280/11.214 |
| 2007/0290462 | A1 | 12/2007 | Bonora et al. | |

FOREIGN PATENT DOCUMENTS

| | | | |
|---|---|---|---|
| AU | 663802 | B2 | 10/1995 |
| CA | 2104907 | A1 | 3/1994 |
| CA | 2104907 | C | 2/1996 |
| DE | 585764 | T1 | 11/1994 |
| DE | 69300905 | | 1/1996 |
| DE | 69300905 | T2 | 4/1996 |
| EP | 0567948 | A1 | 11/1993 |
| EP | 0568878 | A1 | 11/1993 |
| EP | 0585764 | | 3/1994 |
| EP | 0594080 | A2 | 4/1994 |
| EP | 0625063 | A1 | 11/1994 |
| EP | 0594080 | A3 | 2/1995 |
| EP | 0656220 | A2 | 6/1995 |
| EP | 0585764 | B1 | 11/1995 |
| EP | 0567948 | B1 | 9/1996 |
| EP | 0594080 | B1 | 9/1996 |
| EP | 0568878 | B1 | 2/1998 |
| EP | 0625063 | B1 | 4/1998 |
| EP | 0656220 | B1 | 7/1998 |
| ES | 2051671 | T1 | 7/1994 |
| ES | 2051671 | T3 | 2/1996 |
| JP | 06121864 | A | 5/1994 |
| JP | 06154388 | A | 6/1994 |
| JP | 06198023 | A | 7/1994 |
| JP | 06261967 | A | 9/1994 |
| JP | 07185061 | A | 7/1995 |
| JP | 2735775 | B2 | 4/1998 |
| JP | 2786392 | B2 | 8/1998 |
| JP | 3499581 | B2 | 2/2004 |
| KR | 200308217 | Y1 | 3/2003 |
| KR | 1020040050246 | | 6/2004 |
| KR | 200384502 | Y1 | 5/2005 |
| KR | 1020070117404 | | 12/2007 |
| WO | WO9314841 | A1 | 8/1993 |

OTHER PUBLICATIONS http://www.xskating.com/Calf-Brake-II-Powerslide-XC-PATH-Skates::420.html, Website, downloaded on Feb. 2, 2012.

http://www.powerslide.de/en/nordic/accessories/calf-brake-1.html, Website, downloaded on Feb. 2, 2012.

The International Searching Authortiy, Notification of Transmittal of the International Search Report and the Written Opinion of the International Searching Authority, May 15, 2013, 2 pages, Korea.

The International Searching Authortiy, International Search Report, May 15, 2013, 4 pages, Korea.

The International Searching Authortiy, Written Opinion of the International Searching Authority, May 15, 2013, 3 pages, Korea.

* cited by examiner

SKATE BRAKE

FIELD OF THE INVENTION

The present invention relates to brake devices for skates. In particular, the present invention is a skate brake assembly device capable of inhibiting the skating motion of a user when the user moves his or her calf rearward or backwards.

BACKGROUND OF THE INVENTION

Braking devices for roller skates are well known and are used to slow or stop the skater. Conventional skate braking devices typically consist of a resilient material, such as a rubber pad, which is fixedly attached to either the front or rear of the skate or skate frame. When the user wishes to brake, slow, or stop, the user typically pivots the skate about its front or rear wheels and drags this high friction resilient material along the ground. This is typically very difficult to maneuver and likely requires the skater to delicately balance on one skate while trying to drive the brake on the other skate into the ground.

Other braking devices include rotating brakes, which typically consists of a cuff, one or more compression or bending members, and a brake pad. The cuff, sometimes called a quarter, which is typically attached to the skate boot, is coupled to one end of the bending or compression member. The brake pad, which inhibits a skater's movement upon contact, is typically connected to the other end of the compression member. The compression member is also further movably connected around a hinge, such that, as the user moves his calf rearward or backwards, the compression member pivots, causing the brake pad to contact one or more surfaces.

For example, U.S. Pat. No. 5,487,552, issued to Daoust discloses a skate braking device that utilizes a cuff, two L-shaped levers or compression members, and a brake pad. The upper ends of the levers are connected to the cuff and the lower ends of the levers are connected to the brake pad. Each lever has two arms, which are pivotally connected to the chassis of the skate; wherein the upward portions of the arms extend upwardly in general alignment with the skater's leg and the rearward portions of the arms extends rearwardly from the chassis. As the skater moves the cuff rearwardly, the rearward rotation causes a rearward movement on the upper distal ends, thereby moving the brake pad downwardly. The arms are subject to significant bending loads.

Another example of a skate braking device that utilizes a cuff and one or more compression members is U.S. Pat. No. 5,397,137, issued to Pellegrini et. al. The Pellegrini reference discloses a skate braking device, which includes a shoe comprised of a shell for supporting a user's foot; a fixed and pivoted quarter (sometimes called a cuff) for supporting a user's ankle region and transferring braking force into a compression member; support frame for one or more wheels; and one compression member. The compression member is rotatably associated with the quarter and is associated with a guide formed near the support frame. As the user moves the quarter rotatably backwards, the compression member causes the brake pad to rotate so that it interacts with the ground, thereby activating the brake upon movement of the boot quarter, or cuff via the skater's ankle.

While these references include a compression, or a bending member and require a hinged cuff to activate, that inhibits a user's rolling motion when the user moves his calf muscles rearward/backward, these skate braking devices are ineffective and/or inefficient because the stiff and relatively "fixed" boot cuff, which is required for the Pelligrini brake to activate, resists efficient ankle movement, which is key to efficient skating. Both designs lacks the efficiency of a tension member that constrains a user's braking movements upon force applied to the compression member. The new design effectively separates the skating mechanics from the braking mechanics, and only serves to translate rearward movement of the skater's leg or calf into downward movement of the compression member, but otherwise does not constrain the skater's ankle in any way. The new design can be used with a "racing" style low-cut boot with no decrease in braking forces generated. The Pelligrini brake design will only work with a boot with a cuff, and neither design is interchangeable between skates of differing geometries. The new design provides all of the advantages of the prior art, i.e., calf activation while maintaining all wheels in contact with the skating surface (as opposed to traditional "fixed" heel braking, which requires the skater to perform a very awkward motion by pivoting the braking skate onto the back wheel and the brake pad while balancing on the other foot and skate). These devices are also nonadjustable and lack the ability to be customized or interchangeable on different skates a skater may own, which prevent users of skates to swap the brake between skates. This is particularly troublesome for users who skate in rough environments (i.e., a sleeper slope) because such users may need to readjust their brake assemblies for quicker and stronger responses, and as the brake pad wears down. In addition, during times when a skater wishes to skate very efficiently and has no need for braking (for instance, a long flat section with no hazards), these brakes create two problems: (1) a longer total "wheelbase" (fore and aft length from the front of the front wheel to the back of the brake) which inhibits the skater's ability to perform a "cross-over" skating stroke for speed and/or cornering, and (2) there is a very heavy brake pad, usually a dense and heavy rubber or polymer, that is far from the skater's ankle and therefore a mass ("swing weight") that must be overcome by additional energy from the skater.

Therefore, what is needed is a skate braking device that is activated by the user's calf muscles via a compression member that is restrained and guided by a flexible cord; wherein the flexible cord is further restrained by the skating shoe or boot. Preferably, the skate braking device is adjustable and customizable, such that the brake may fit any combination of boot, frame, wheel size, or skater size. Further, a brake is needed that can be easily reconfigured over the duration of a skate that may involve differing braking needs, including a "stowed" position wherein the brake can be put in a position that has lower "swing weight" (i.e., closer to the skater's ankle) and a shorter total wheelbase (fore and aft length).

SUMMARY OF THE INVENTION

To minimize the limitations in the prior art, and to minimize other limitations that will become apparent upon reading and understanding the present specification, the present invention discloses a new and useful skate brake device.

One embodiment of the present invention is a skate brake assembly, comprising: one or more primary tension members; a cuff; one or more compression members; a brake frame; and a brake pad; wherein a first end of the one or more primary tension members are configured to be attached to a skate, and wherein a second end of the one or more primary tension members are attached to the cuff. The cuff is configured to be attached or aligned to a leg of a user, such that when the leg pushes rearward, the cuff is also pushed rearward. An upper end of the one or more compression members is attached to the cuff, and a lower end of the one or more compression members is attached to the brake frame. The brake frame is configured to be connected to the skate, and the brake pad is attached to the brake frame. The brake pad is configured to contact one or more surfaces being skated on. As the leg of the user pushes rearward, the cuff pushes the one or more compression members rearward. As the one or more compression members is pushed rearward, the one or more primary tension members constrain the backward motion of the one or more compression members, such that the one or more compression members is pushed substantially downward. As the one or more compression members is pushed substantially downward, the brake frame is pushed downward, such that the brake pad contacts the one or more surfaces being skated on. Preferably, the skate brake assembly further comprises: one or more second tension members; wherein a first end of the one or more second tension members are preferably configured to be attached to the skate, and a second end of the one or more second tension members are preferably attached to the brake frame. Preferably, the one or more second tension members are configured to hold the brake frame in a neutral position, such that the brake pad is not in contact with the one or more surfaces being skated on when the leg is not pushed backwards. Preferably, the skate brake assembly further comprises: one or more third tension members; wherein a first end of the one or more third tension members should be connected to the one or more primary tension members and a second end of the one or more third tension members should be configured to be connected to the skate, such that the one or more third tension members substantially aligns the one or more primary tension members. Preferably, the brake frame rotatably attaches to a pivot, such that when the one or more compression members pushes downwards, the brake frame pivots downwards, and when the one or more compression members is not pushing down, the brake frame pivots to the neutral position by virtue of the second tension member. The length of the one or more compression members, and all tension members, may be adjustable. The skate brake assembly preferably is configured to include a stowed position; wherein the stowed position occurs when the brake frame pivots upwards, such that the brake pad is substantially away from the one or more surfaces. In this position, the one or more compression members, cuff and primary tension member may be easily detached and stowed in the skater's pocket or pack, or be slung over the shoulder when braking is not required, thereby lowering the weight the skater is "swinging" on their leg and shortening the wheelbase allowing efficient cross-over skating. Preferably, the leg of the user is a calf. The brake frame may be adjustable to one or more wheel sizes, such that the user may reposition the pivot at one or more hinge points of the brake frame. The brake frame may be adjustable to one or more braking forces, such that the user may reposition the lower end of the one or more compression members to one or more connections points of the brake frame.

Another embodiment of the present invention is a skate brake assembly, comprising one or more primary tension members; a cuff; one or more compression members; a brake frame; and a brake pad. A first end of the one or more primary tension members are configured to be attached to a skate. A second end of the one or more primary tension members are attached to the cuff. The cuff is configured to be attached, or aligned, to a calf of a user, such that when the calf pushes rearward, the cuff is also pushed rearward. An upper end of the one or more compression members is attached to the cuff. A lower end of the one or more compression members is attached to the brake frame. The brake frame is configured to be connected to the skate. The brake pad is attached to the brake frame. The brake pad is configured to contact one or more surfaces being skated on. As the calf of the user pushes rearward, the cuff pushes the one or more compression members rearward. As the one or more compression members is pushed rearward, the one or more primary tension members constrain the backward motion of the one or more compression members, such that the one or more compression members is pushed substantially downward, and, as the one or more compression members is pushed substantially downward, the brake frame is pushed downward, such that the brake pad contacts the one or more surfaces being skated on. Preferably, the skate assembly further comprises: one or more second tension members; wherein a first end of the one or more second tension members are configured to be attached to the skate, and a second end of the one or more second tension members are attached to the brake frame. Preferably, the one or more second tension members are configured to hold the brake frame in a neutral position, such that the brake pad is not in contact with the one or more surfaces being skated on when the calf is not pushed backwards. Preferably, the skate brake assembly further comprises: one or more third tension members; wherein a first end of the one or more third tension members should be connected to the one or more primary tension members and a second end of the one or more third tension members should be configured to be connected to the skate, such that the one or more third tension members substantially aligns the one or more primary tension members. Preferably, the brake frame rotatably attaches to a pivot, such that when the one or more compression members pushes downwards, the brake frame preferably pivots downwards, and when the one or more compression members is not pushing down, the brake frame preferably pivots to the neutral position. Preferably, the skate brake assembly is configured to a stowed position; wherein the stowed position occurs when the brake frame pivots upwards, such that the brake pad is preferably substantially away from the one or more surfaces. Preferably, the brake frame is adjustable to one or more wheel sizes, such that the user may reposition the pivot at one or more hinge points of the brake frame. The brake frame may be adjustable to one or more braking forces, such that the user may reposition the lower end of the one or more compression members to one or more connections points of the brake frame. A length of the one or more compression members may be adjustable.

Another embodiment of the present invention is a skate brake assembly, comprising: one or more primary tension members; a skate; a cuff; one or more compression members; a brake frame; a brake pad; one or more second tension members; and one or more third tension members. A first end of the one or more primary tension members are configured to be attached to the skate. A second end of the one or more primary tension members are attached to the cuff. The cuff is configured to be attached or aligned to a calf of a user, such that when the calf pushes rearward, the cuff is also pushed rearward. An upper end of the one or more compression members is attached to the cuff. A lower end of the one or more compression members is attached to the brake frame. The brake frame is configured to be movably connected to the skate. The brake frame rotatably attaches to a pivot, such that when the one or more compression members pushes downwards, the brake frame pivots downwards, and when the one or more compression members is not pushing down, the brake frame pivots to the neutral position. The pivot is preferably configured to be located on a wheel axle of the skate. The brake frame is adjustable to one or more wheel sizes, such that the user may reposition the pivot at one or more hinge points of the brake frame. The brake frame is adjustable to one or more braking forces, such that the user may reposition the lower end of the one or more compression members to one or more connections points of the brake frame. The brake pad is attached to the brake frame, and the brake pad is configured to contact one or more surfaces being skated on. As the calf of the user pushes rearward, the cuff pushes the one or more compression members rearward. As the one or more compression members is pushed rearward, the one or more primary tension members constrain the backward motion of the one or more compression members, such that the one or more compression members is pushed substantially downward. As the one or more compression members is pushed substantially downward, the brake frame is pushed downward, such that the brake pad contacts the one or more surfaces being skated on. A first end of the one or more second tension members are configured to be attached to the skate. A second end of the one or more second tension members are attached to the brake frame. The one or more second tension members are configured to hold the brake frame in a neutral position, such that the brake pad is not in contact with the one or more surfaces being skated on when the calf is not pushed backwards; and wherein a first end of the one or more third tension members are connected to the one or more primary tension members and a second end of the one or more third tension members are configured to be connected to the skate, such that the one or more third tension members substantially aligns the one or more primary tension members.

It is an object of the present invention to create a skate brake assembly that is activated by the user's calf through one or more compression members that is restrained by a flexible tension cord, which, in turn, is restrained by another tension member that is connected to the bottom of the skate, shoe, or frame. This other tension member, which is the referred to as the third tension member, as detailed herein, may be any elastic or inelastic cord, which may be a lace of a skate, or any mechanism to keep the primary tension member from flapping around and to keep it aligned with the skate and skater's leg.

It is an object of the present invention to create a skate brake assembly, which is adjustable such that the brake may be retrofitted on to any type skate, which may include inline or quad skates, regardless of the size or type of the skate boot, frame, wheel size, skater size, and skater preferences.

It is an object of the present invention to provide a brake that provides a very high level of braking force.

It is an object of this invention to provide a brake that is activated while keeping all wheels of both skates in contact with the skating surface during the braking maneuver It is an object of this invention to provide a brake that can be easily reconfigured during the course of a skating outing to meet different braking requirements while providing the most efficient brake possible (i.e., the lowest swing weight, shortest wheelbase, and least interference to the movement of the skater's ankle).

It is an object of the present invention to provide a skate brake assembly that incorporates multiple modes of braking such as: "Max-brake" rotating for heavy braking; "Medium Brake" for low to moderate braking; and "Stowed" (or removed" for situations where no brake is needed (such as for speed skating, urban skating, slalom or "cone" skating, or hockey)). Preferably, the present invention makes changing from one mode to another very quick and easy (i.e., from "Max-brake" to "Medium Brake" to "stowed" to off configuration, and vice-versa) by combining the tension members, compression members, and brake frame with various fasteners such as pins, bolts, screws, and the like.

It is an object of the present invention to provide a skate brake assembly that uses many off-the-shelf and readily available commodity brake pads, unlike most conventional skate brakes, which require a purpose-designed/matched brake pad.

It is an object of the present invention to provide a skate brake assembly that allows the skater or user to apply braking forces from both feet at the same time, such that the user is not restricted to a "one foot" stoop and thereby able to create greater braking forces from both skates.

It is an object of the present invention to provide a skate brake assembly that is easy to learn, easy to use, and provides a high level of reassurance and stability to the skater.

It is an object of the present invention to provide a skate brake assembly that can be adjusted and assembled to virtually any skate without any significant modifications required to the skate.

It is an object of the present invention to provide a brake that is effective when used on long-wheelbase skates, such as downhill or cross country skates, and with low-cut speed skating shoes with any diameter wheels.

It is an object of the present invention to overcome the limitations of the prior art.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE DRAWINGS

Figure 1:
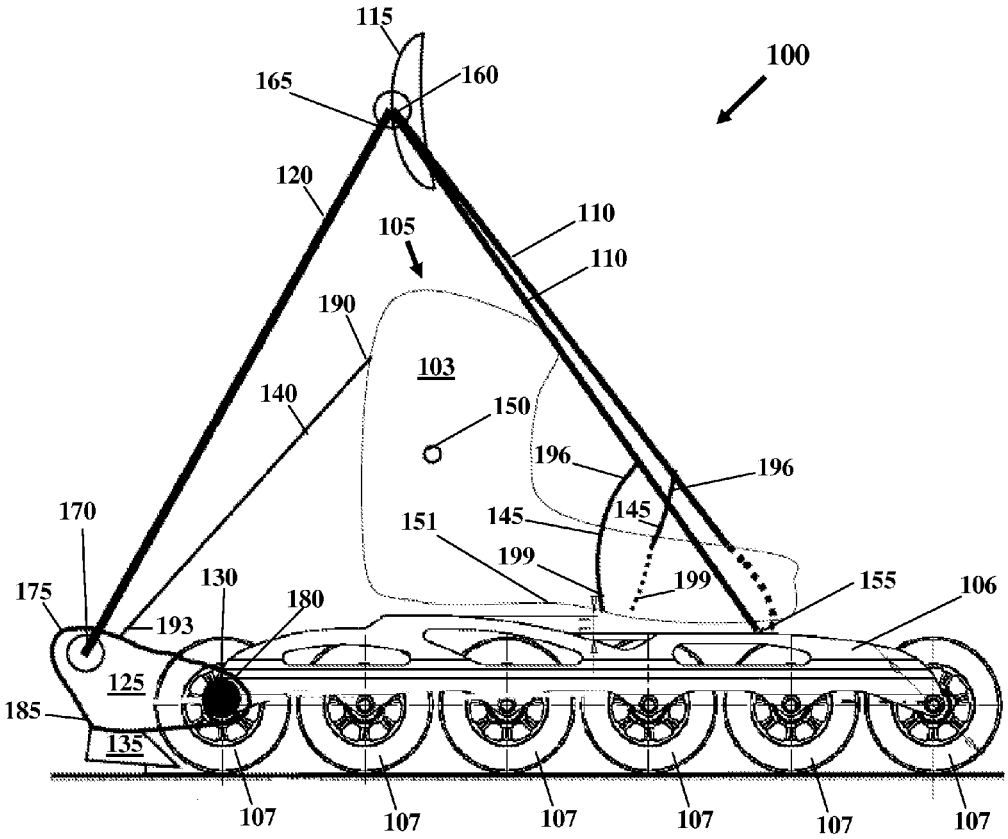
FIG. 1 is an illustration of a side view of one embodiment of the skate brake assembly.

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

In the following description, certain terminology is used to describe certain features of one or more embodiments of the invention. For instance, the terms "skate" and "skating device" refers to any devices worn on the feet to enable the wearer to roll along on one or more wheels, including without limitation, inline skates and quad skates. The skating device also preferably includes a boot, frame, bearings, wheels, and brakes, but may lack one or more components without deviating from the scope of the invention. The term "compression member" refers to any rigid piece of material that provides further movement and support in response to any applied force, and includes without limitation, rods, sticks, poles, shafts, stalks, levers, canes, bars, and the like. The term "primary tension member" refers to any inelastic structural elements that are subjected to axial tensile forces, and includes without limitation, inelastic cords, cables, ropes, coaxials, inelastic cords, links, ropes, wires, and the like. The terms "second tension member" and "third tension member" refer to any elastic structural elements that are subjected to axial tensile forces, and includes without limitation, elastic cords, elastic ropes, elastic cables, stretchable strings, cords, wires, and the like. The second tension member may also be a rotary/coil spring that applies a rotary force to the brake to keep it up or can simply loop around the front of the skater's ankle/skate boot ankle and not actually attach anywhere. The third tension member may also be any mechanism that keeps the primary tension member "tidy", (i.e., not flopping around), such that when the skater moves calf back the primary tension member is well positioned to keep the cuff straight on the skater's leg as it moves back. The term "cuff" refers to any mechanism or device that fastens, secures, aligns or adheres to a user's leg, calf, ankle, or skate boot, and includes without limitation, fasteners, straps, quarters, and the like.

The skate brake invention is preferably a friction brake that may be designed to work with any type of skating device. The skate brake and components thereof are preferably adjustable and/or can be made specifically to fit virtually any skate or skater. The skate brake is preferably comprised of a cuff, compression member, brake frame, brake pad, one or more primary tension members, one or more second tension members, and one or more third tension members. The cuff, which is preferably, but not always, attached to the back of a wearer's calf, operates such that when the calf is pushed rearward or backward, the cuff is also pushed backward. The compression member, which is a preferably a rigid and telescoping rod, is attached to the cuff and the brake frame. The compression member may also have a damping mechanism incorporated to reduce the vibration that the skate feels from the cuff due to bumps or irregularities in the skating surface. The primary tension member, which is a flexible but inelastic strap, is preferably attached to the front portion of a skate and to the cuff. As the cuff is pushed backward, the primary tension member constrains the backward motion of the compression member and forces the compression member more forcefully downward. The downward movement of the compression member, in turn, pivots the brake frame downward, which causes the brake pad to engage the ground. The secondary tension member, which is flexible and elastic, is attached to the brake frame and to one of several different positions of the back or bottom of the skate shoe. Preferably, the second tension member holds the brake frame in a stable or neutral position (i.e., ready-to-brake) during normal skating, such that the brake pad does not contact with any surfaces that are skated on. When the compression member ceases pushing down on the brake frame (by the user moving his/her calf forward), the second tension member pulls the brake frame into its normal position. The tension in the second tension member is preferably overcome when the compression member is forced down. The third tension member, which is preferably flexible and elastic, is connected to the primary tension member and is designed to keep the primary tension member properly aligned. As discussed above, the second tension member may also be a rotary/coil spring that applies a rotary force to the brake to keep it up, or can simply loop around the front of the skater's ankle/skate boot ankle and not actually attach anywhere. Like the second tension member, the primary tension member can also simply loop around the front of the skater boot or middle of the skate boot and not actually attach anywhere. The third tension member may be any mechanism that keeps the primary tension member "tidy", (i.e., not flopping around), such that when the skater moves calf back the primary tension member is well positioned to keep the cuff straight on the skater's leg as it moves back. Although the skate brake invention does not have to include all of the tension members, the present invention works best when all of the tension members, or similar function mechanism is present.

FIG. 1 is an illustration of a side view of one embodiment of the skate brake assembly. As shown in FIG. 1, the skate brake assembly 100 preferably includes: a skate 105 primary tension member 110; cuff 115; compression member 120; brake frame 125; pivot 130; brake pad 135; second tension member 140; third tension member 145; and an attachment point 150, 151. The skate 105 preferably includes a skate shoe 103; a skate frame 106, and one or more skate wheels 107. Although FIG. 1 shows a skate shoe 103 as a boot, it should be understood that the present invention allows the skate shoe 103 to include any type of footwear device such as a boot, shoe, slippers, sandal, straps, socks, but also may incorporate no footwear device. The user's foot preferably wears the skate shoe 103 or boot, and the skate shoe 103 is preferably attached to the skate frame 106. The skate frame 106 is preferably any structural device that is fixedly attached to the skate shoe 103 and usually holds skate wheels 107, such that the wheels are freely rotatable. While FIG. 1 only shows the skate shoe 103, skate frame 106, and skate wheels 107 as part of a six wheel in-line skate, it should be understood that skate brake assembly 100 may be attached to any type of skate with any number of wheels, including, but not limited to, inline, two-wheel, and quad skates, without deviating from the scope of the invention.

Figure 2:
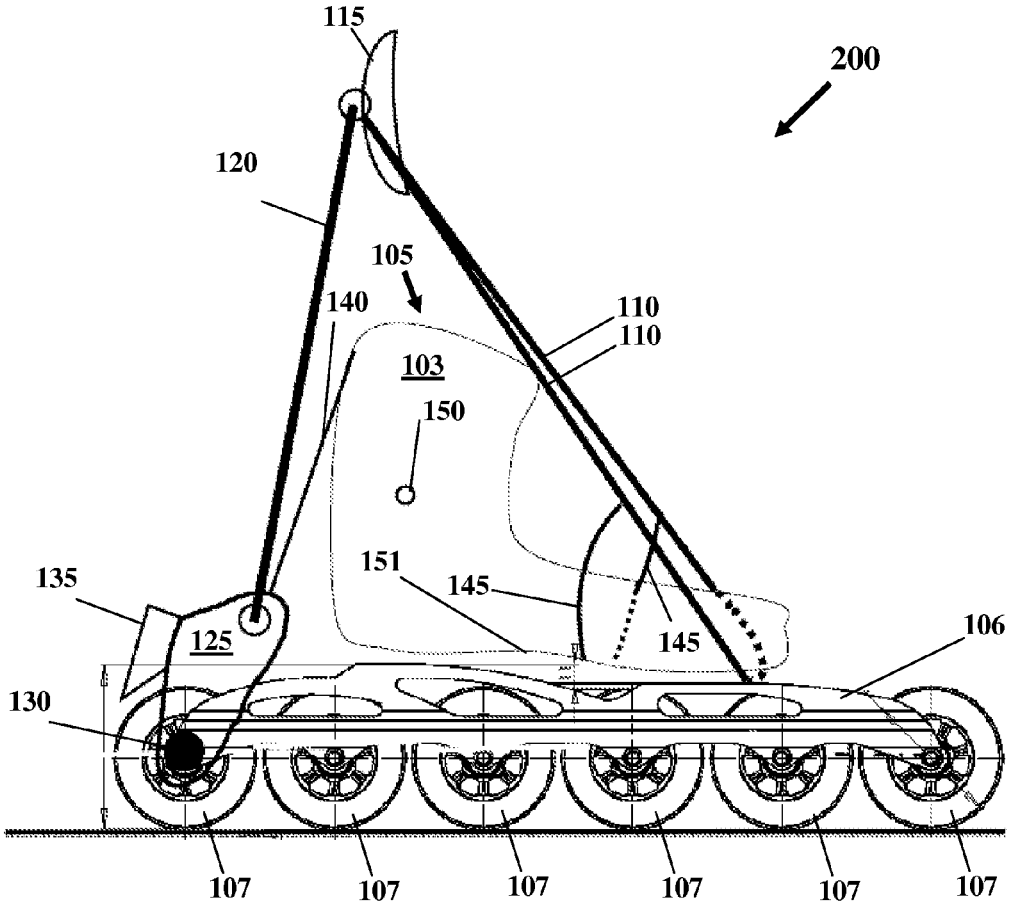
FIG. 2 is an illustration of a side view of one embodiment of the skate brake assembly and shows the skate brake assembly in a stowed configuration.
Figure 7:
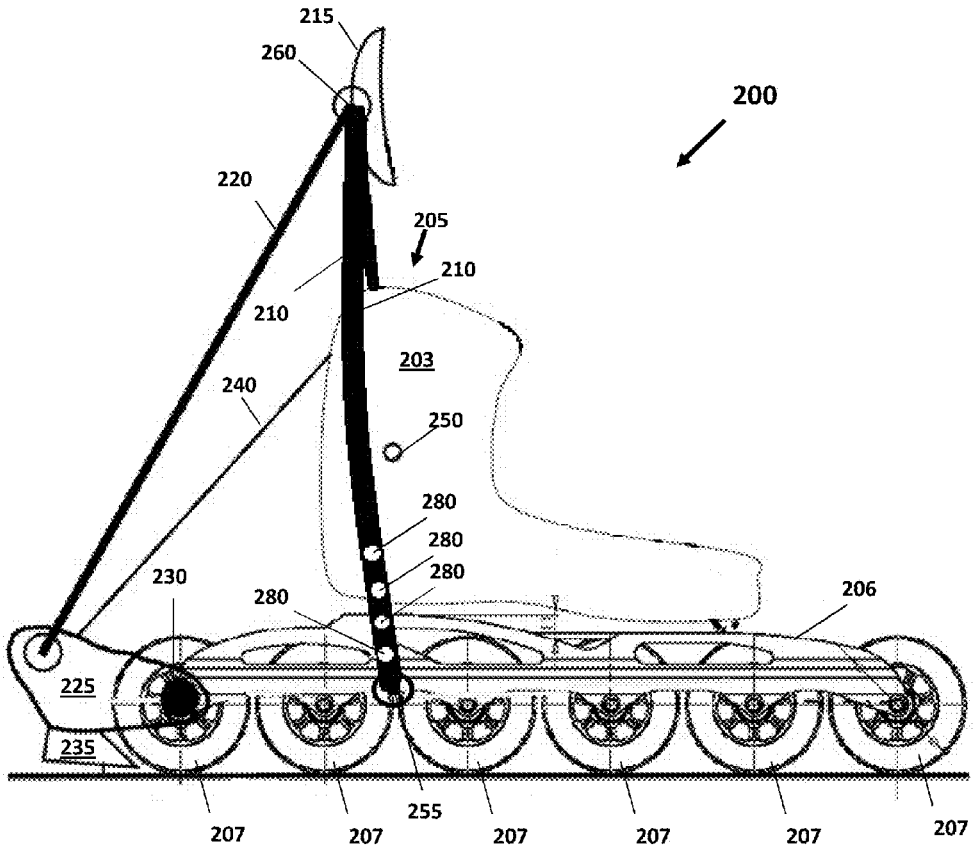
FIG. 7 is an illustration of a side view of one embodiment of the skate brake assembly and shows the primary tension member as an inelastic and bendable, semi-rigid or rigid strap, wherein the first end of the primary tension member is attached to the skate frame.
Figure 8:
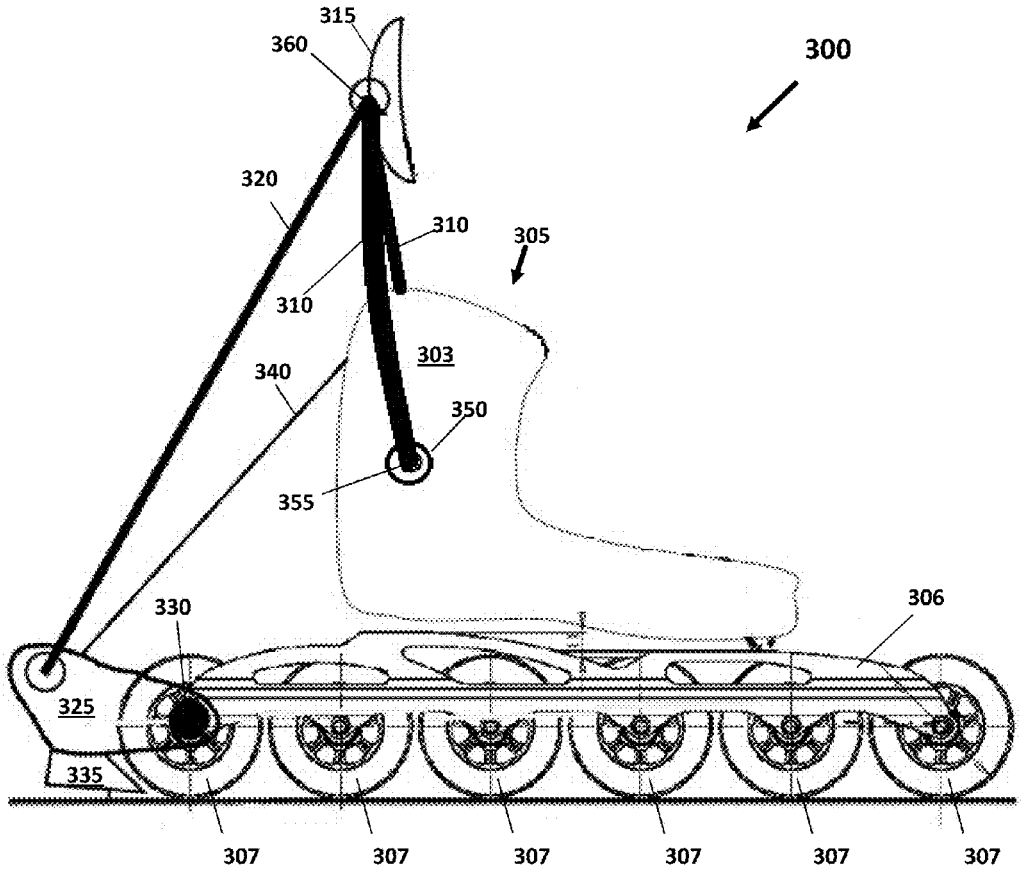
FIG. 8 is an illustration of a side view of one embodiment of the skate brake assembly and shows the primary tension member as an ineastic and bendable, semi-rigid or rigid strap, wherein the first end of the primary tension member attached to the skate shoe.

The primary tension member 110, as shown in FIGS. 1 and 2, is preferably one or more narrow strips of material that are flexible, but not elastic, and may be constructed of wire, rope, cord, string, nylon, and/or the like. However, as shown in FIGS. 7 and 8, the primary tension member(s) 110 may be constructed of any rigid or semi-rigid but inelastic material such as a bendable or somewhat-flexible metal strap, pieces of strip metal, or semi-rigid or rigid plastic or composite strips or the like. It should be understood that the primary tension member could be made from any type of rigid or semi-rigid but inelastic natural or man-made material. The length of the primary tension member 110 may also be adjusted by utilizing adjustment holes, locks, sliders, or the like, such that the user may configure the primary tension member 110 to be any length, width, or height, in accordance with the user's preferences, the most important/critical preferences being the ankle angle that begins engagement of the brake and/or the ankle angle where the brake is in contact with the skating surface. The cuff 115 is preferably a device that wraps, fastens to, or is secured (loosely or securely depending on skater preferences) around a user's calf, leg, or ankle 105, which includes any fastener and/or quarter, but may also be configured to be aligned to a user's calf or leg rather than being attached to a user. The cuff 115 also is typically constructed of any pliant material such as plastic or nylon that may include a strap or fastening device, but may also be constructed of any rigid or hard, inflexible material as well. The compression member 120 is preferably any thin, rigid straight or shaped piece of inflexible and inelastic material such as metal or wood bar or dowel or composite or reinforced plastic. The cuff and compression member can be one piece, for example molded plastic, aluminum or composites, or many pieces that are secured together rigidly, or flexibly but securely. The compression member or members may also be adjustable, such that the user may configure the compression member to be any length, or height, in accordance with the user's preferences, (the primary preference being the ankle angle that begins engagement of the brake and/or the ankle angle where the brake is in contact with the skating surface) and may also have a damping mechanism incorporated to reduce the vibration that the skate feels from the cuff due to bumps or irregularities in the skating surface. The brake frame 125 is preferably a device that pivots or rotates around the pivot 130, which is preferably attached to an end of skate frame 106, and like the compression member, is fully adjustable by the user to create differing brake forces. The pivot 130 may be co-axial/common with one of the skate wheel axles, may be a pivot on the frame, or may be a pivot on a separate bracket that attaches to the boot and or frame. However, the pivot is preferably fixed with respect to the skate and should not move. As shown in FIG. 1, brake frame 125 cradles or holds brake pad 135, which is pressed or makes contact with the ground in order to slow, brake, or stop the skater. The brake pad 135 may be any off-the-shelf brake pad, or proprietary brake pad.

Both the second tension member 140 and the third tension member 145 are preferably long narrow strips of pliant material, but, unlike the primary tension members 110, both the second tension members 140 and third tension members 145 are preferably constructed of an elastic material that returns to its original shape after any stress that deforms or distorts the tension member is removed. The present invention allows the primary tension member 110, second tension member 140, and third tension member 145 to be fully adjustable by the user to comport with the user's needs and preferences.

Attachment point 150 may be an alternate point of attachment for the first or second tension members. Although attachment point 150 is shown in FIG. 1 as being on skate shoe 103, it may be located in any location of the skate 105. Also, the first, second and third tension members may simply wrap around the skate boot. The components of the skate brake assembly 100 may be constructed from any natural, synthetic, or manmade material such as, metal, aluminum, stainless steel, leather, composites, plastic, reinforced plastics and the like, without deviating from the scope of the invention.

FIG. 1 shows the preferred interconnections of the components of the brake assembly 100. As shown in FIG. 1, a first end 155 of the primary tension member 110 is preferably attached, connected, or otherwise aligned to the skate 105 by connecting the first end 155 of the primary tension member 110 to any part of the skate 105, which includes the skate shoe 103, skate frame 106 or other components of the skate 105. Attaching the first end 155 of the primary tension member 110 may also be accomplished by forming a loop at the first end 155 of the primary tension member 110 and looping the first end 155 of the primary tension member 110 to under any part of the skate 105, or component of the skate 105. The second end 160 of the primary tension member 110 is shown as preferably being connected to the cuff 115 and upper end 165 of the compression member 120. Although FIG. 1 shows: (1) the first end 155 of the primary tension member 110 as attached to the front portion of the skate 105; and (2) the upper end 160 as attached to cuff 115; it should be understood that the primary tension member may be attached at any location on skate 105, cuff 115, and/or skate frame 106 (including but not limited to the attachment point 150), so long as the primary tension member constrains the backward movement of the compression member due to the inelasticity of the primary tension member 110. This constraint forces the compression member 120 downward, rather than merely backward, with a strong braking force when the wearer shifts her calf backward. For example, the first end 155 of the primary tension member 110 may be attached to the front portion of the skate 105 while the second end 160 of the primary tension member 110 may be connected to the upper portion 165 of the compression member 120 (see example in FIG. 9). Alternatively, the second end 160 of the primary tension member 110 may be connected to the upper portion 165 of the compression member 120 while another portion of the primary tension member 110 may be connected to the cuff 115 (see example in FIG. 10).

Preferably, the upper end 165 of the compression member 120 is connected to the cuff 115, and the lower end 170 of the compression member 120 is preferably connected pivotally to a first end portion 175 of the brake frame 125. The second portion 180 of the brake frame 125 is preferably connected at pivot 130 to a rear portion of the skate frame 106. Preferably, the brake pad 135 is connected to a third or lower portion 185 of the brake frame 125.

FIG. 1 shows that, preferably, the first end 190 of the second tension member 140 is connected to a rear, upper portion of the skate shoe 103, and the second end 193 of the second tension member 140 is preferably connected to first portion 175 of the brake frame 125. Although FIG. 1 shows the second tension member connected to the skate 105 and brake frame 125, it should be understood that the present invention allows the second tension member 140 to be connected to other parts of the skate 105 without deviating from the scope of the invention (see examples in FIG. 3). For example, the first end 190 of the second tension member 140 may be attached to the skate 105 while the second end 193 of the second tension member 140 may be connected to the lower end 170 of the compression member 120 (see example in FIG. 11).

The first end 196 of the third tension member 145 is preferably connected to the primary tension member 110 and the second end 199 of the third tension member 145 is preferably connected to a lower portion of the skate 105, or simply wraps under the skate 105 or skate shoe 103. Although FIG. 1 shows the third tension member 145 with specific attachment points, it should be understood that the present invention allows a wide variety of attachment points.

It should be understood that not all of the tension members 140, and 145 are necessary for the operation of skate brake assembly 100. The tension members 110, 140, and 145 may each be constructed from any number of parts or a single part.

As shown in FIG. 1, the skate brake assembly 100 operates to brake, slow, or stop a skater when the skater shifts her calf or leg backward. First, the cuff 115 moves back or rearward. This pushes the compression member 120 rearward, but instead of going rearward, the rod is pushed primarily downward due to the constraining action of the primary tension member 110. The primary tension member, and the cuff, forces compression member 120 to stay aligned on the back of the wearer's calf and forces compression member 120 downward rather than rearward when the skater's calf moves backward. As a result of the strong downward force on compression member 120, the brake frame 125 pivots downward, which in turn brings brake pad 135 in contact with the ground or surface upon which the skater is skating. The skater controls the force at which the brake pad 135 contacts the ground by lessening or increasing the rearward movement of the calf The second tension member 140, or similar function part like a coil spring, is used to hold the brake frame 125 in a stable or neutral position above the ground until it is overcome by the rearward movement of the user's calf and the downward movement of the compression member 120. In the neutral position, the second tension member holds the brake frame in a stable position, such that the brake pad is not in contact with one or more surfaces, such as the ground surface when the braking force of the skate brake assembly 100 is not applied, The third tension member 145 is used to, optionally, help keep the primary tension member 110 aligned to the skate 105 and the skaters leg/calf to optimally convert the rearward movement of the user's calf into a downward force on compression member 120.

FIG. 2 is an illustration of a side view of one embodiment of the skate brake assembly and shows the skate brake assembly in a stowed configuration. As shown in FIG. 2, the stowed configuration 200 of the skate brake assembly 100 preferably includes: a skate shoe 103; primary tension member 110; cuff 115; compression member 120; brake frame 125; pivot 130; brake pad 135; second tension member 140; third tension member 145; and attachment point 150. The stowed configuration 200 preferably includes the brake frame 125 pivoting in an upwards fashion, such that the brake pad 135 is substantially away from the ground surface and/or wheel of the skate 105, and in a position that does not hinder efficient skating in situation where no braking is required. In this position, compression member 120 does not force the brake pad 135 to the ground when the skater's calf moves rearward. Although it is preferred that the stowed position be held by a snap or friction, it should be understood that the stowed position may be held by any mechanism or simply by gravity.

Figure 3:
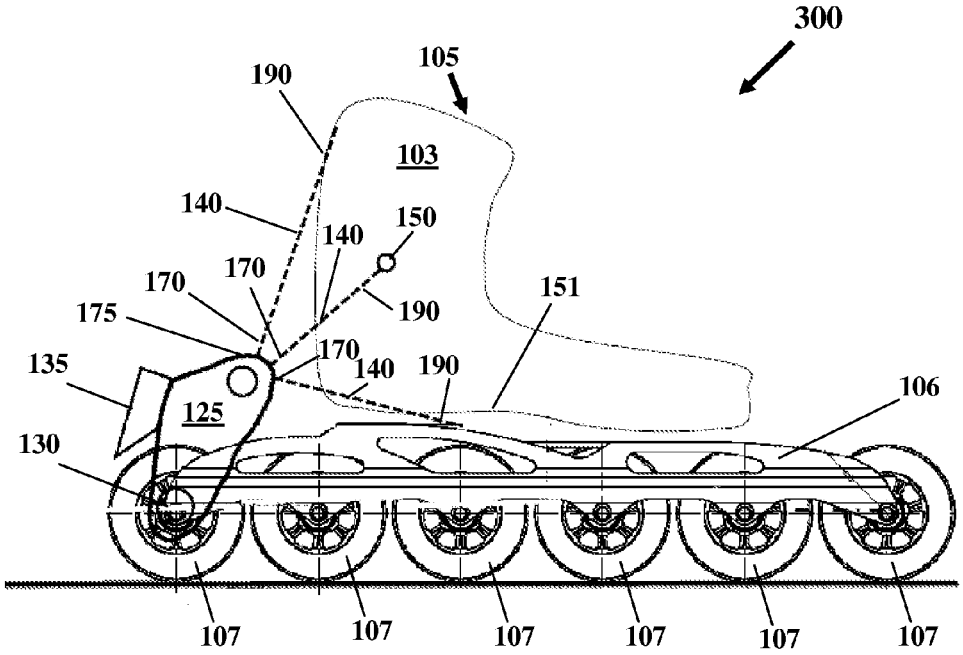
FIG. 3 is an illustration of a side view of one embodiment of the skate brake assembly and shows another stowed configuration and various placements of the second tension member.

FIG. 3 is an illustration of a side view of one embodiment of the skate brake assembly and shows another stowed configuration and various placements of the second tension member. As shown in FIG. 3, the alternate stowed configuration 300 of the skate brake assembly preferably includes: a skate 105; brake frame 125; pivot 130; brake pad 135; one or more second tension members 140; and attachment point 150. As mentioned above, the various configurations of the second tension member 140 of the brake assembly 100 preferably includes the brake frame 125 pivoting in an upwards fashion, such that the brake pad 135 is substantially away from the ground surface and in a position that does not hinder efficient skating in situation where no braking is required. As shown in FIG. 3, the compression member, cuff and first and second tension members have been removed to reduce the swing weight on the skaters foot. The first and second tension members may be removed by a quick release pin, which is preferably located at the second end of the second tension members 170 but may be located at any area of any of the tension members. The first end of the second tension members 190 may be attached to various portions of the skate 105. For instance, the first end 190 of the second tension member 140 may be attached to an upper-rear end portion of the skate shoe 103, attachment point 150, or bottom portion of the skate frame 106, or simply wrapped over the top of the skater's foot/skate boot/shoe. The second end of the second tension members 170 is preferably attached to the first or rear-top end portion 175 of the brake frame 125.

Figure 4:
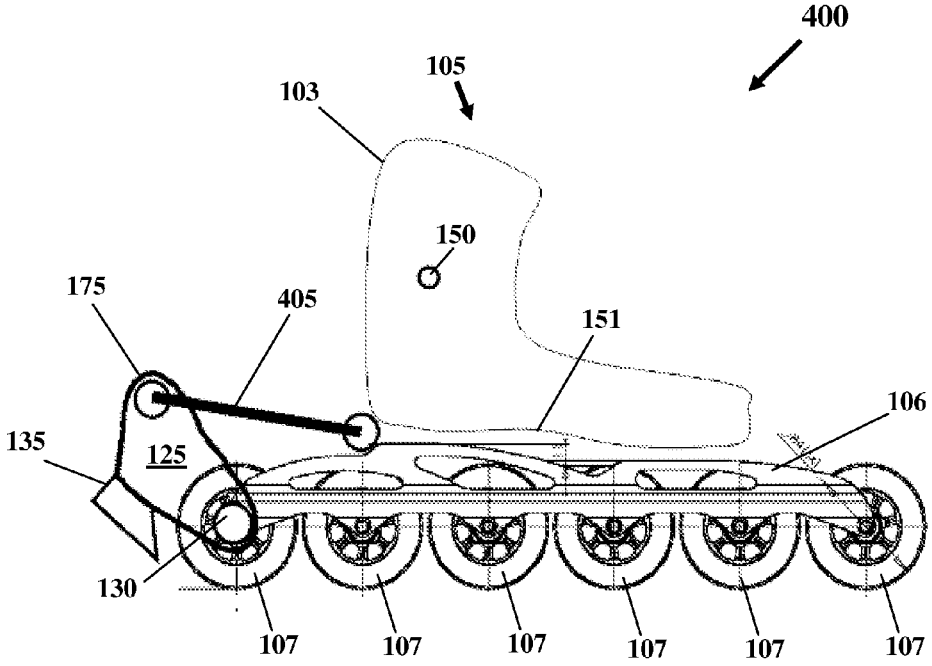
FIG. 4 is an illustration of a side view of one embodiment of the skate brake assembly and shows a medium brake configuration.

FIG. 4 is an illustration of a side view of one embodiment of the skate brake assembly and shows a medium brake configuration. As shown in FIG. 4, the medium brake configuration 400 of the skate brake assembly 100 is typically a traditional heel brake configuration and preferably includes: a skate 105; brake frame 125; pivot 130; brake pad 135; attachment point 150, 151; and heel brake compression member 405. In this configuration, the present invention is a retrofit of the skate brake assembly 100. The cuff 115 and compression member 120 are preferably replaced by a heel brake compression member 405, which is typically a shorter version of the compression member 120. The heel brake compression member 405 preferably allows the user to perform low to moderate braking by bearing against the user's skate boot, lower leg, skate, and allowing the user to brake as needed by compressing the heel brake compression member 405. Unlike conventional heel brakes, the heel brake compression member 405 preferably replaces the compression member 120 in a quick release manner through the use of clevis pins, cotter pins, screws, bolts, and the like. Preferably, the heel brake compression member 405 may be adjustable in length to tailor a skater's preference, to address issues such as comfort, brake and pad wear, but is typically fixed once adjusted. This configuration also allows the user to preferably adjust the brake's settings to require less power than the maximum brake configuration, and preferably allows a user to utilize multiple styles of braking from skate brake assembly 100 components.

Figure 5:
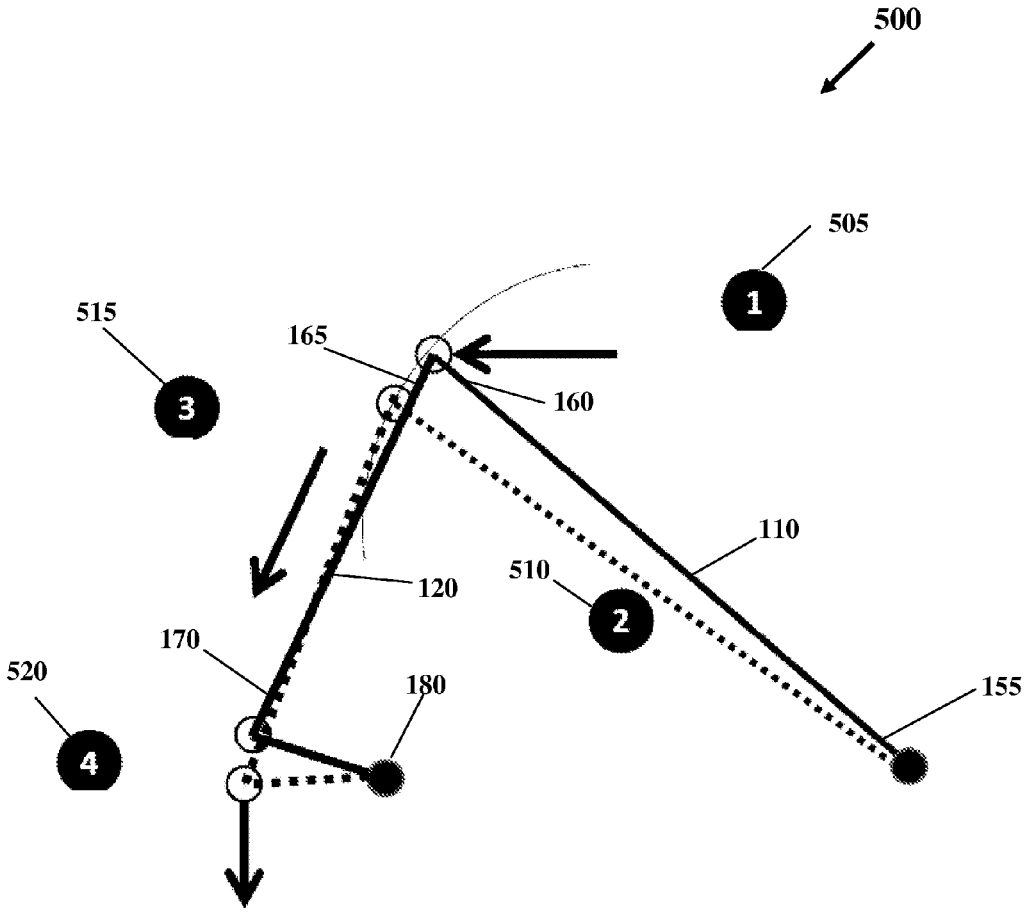
FIG. 5 is a force diagram of one embodiment of the skate brake assembly.

FIG. 5 is a force diagram of one embodiment of the skate brake assembly. As shown in FIG. 5, the force diagram 500 of one embodiment of the skate brake assembly shows the preferred steps of: (1) applying a rearward force 505 to cuff 115; (2) constraining of the rearward movement of the rod 510 by primary tension member 110; (3) generating a downward motion and force 515 on compression member 120; and (4) generating a braking force to the brake pad 520. Specifically, in the first step, applying a rearward force 505, the user preferably moves his or her calf or leg rearward or backwards such that the cuff 115 also moves rearward. The second step, constraining of the rearward movement of the rod 510, preferably occurs when the primary tension members 110 is fully extended, due to the inelasticity of the primary tension members 110. Accordingly, the upper part of the primary tension member cannot move rearward, which in turn constrains the backward movement of the compression member 120. The third step, generating a downward motion and force 515, typically occurs when the by user's calf generates a rearward movement, thereby causing the compression member 120, which is constrained from moving rearward, is forced downward. The primary tension member 110 also helps increase the efficiency and strength of the downward force of the compression member 120 because the compression member 120 is kept aligned at the back of the wearer's calf and is prevented from swinging or slipping around to the front of the wearer's leg. Finally, the fourth step, generating a braking force to the brake pad 520, preferably occurs when the downward motion generated by the compression member 120 forces the brake pad 135 to contact with the ground or other surface on which the skater is skating.

Figure 6:
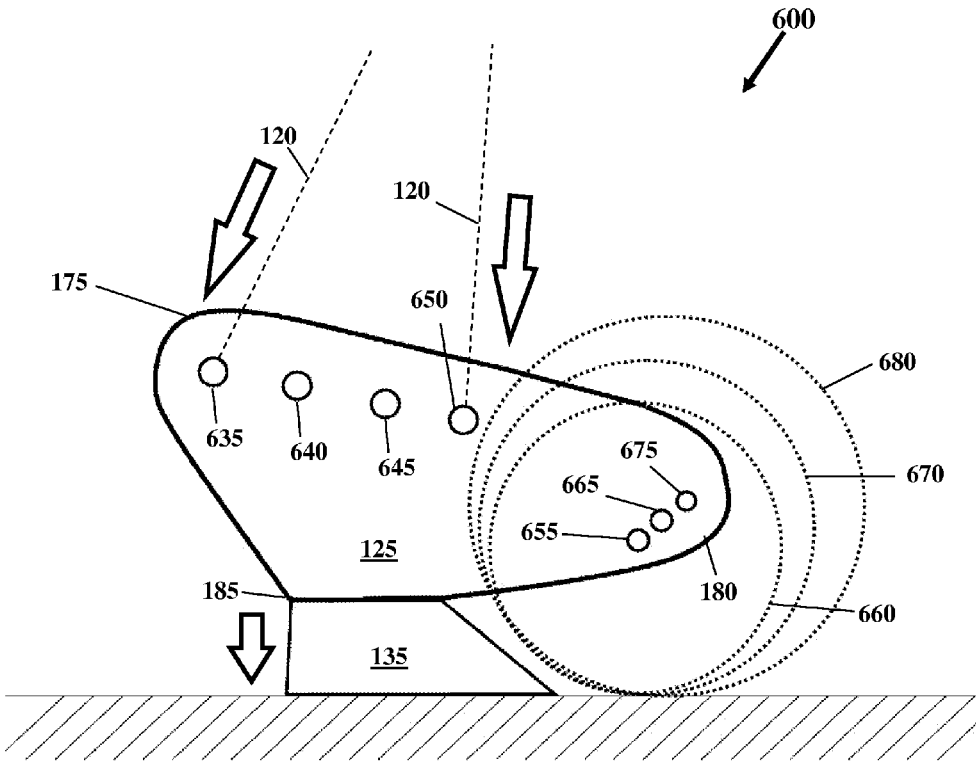
FIG. 6 is a detailed illustration of a side view of one embodiment of a brake frame and brake pad of the skate brake assembly.

FIG. 6 is a detailed illustration of a side view of one embodiment of a brake frame and brake pad of the skate brake assembly. As shown in FIG. 6, both the brake frame 125 and brake pad 135 preferably include: a first side or end 175 of the brake frame 125; a second side or end 180 of the brake frame 125; a third side or end 185 of the brake frame 125; compression member 120; one or more hinge points 655, 665, 675; and wheel 660, 670, 680. The first end 175 of the brake frame 125 preferably includes one or more connection points 635, 640, 645, 650, which are used to achieve different motion responses and braking forces generated from the compression member 120 to accommodate different skate wheel sizes and the braking desires of the skater. For example, if compression member 120 is attached to connection point 635, the motion response would be slow, with a small angular rotation and a very strong brake force. If compression member 120, on the other hand, is attached to connection point 650, the motion response should be fast with a large angular rotation and a weaker brake force. Although FIG. 6 shows only four connection points, the present invention allows any number of connection points or a single connection point, without deviating from the scope of the invention. Additionally, the brake frame 125 is preferably able to accommodate different types of brake pads or a proprietary single purpose brake pad. The second end 180 of the brake frame 125 may include one or more hinge points 655, 665, 675 to accommodate different wheel sizes and skate frames. For example, hinge point 655 would accommodate a small wheel 660; hinge point 665 would accommodate a medium sized wheel 670; and hinge point 675 would accommodate a large wheel 680. However, the present invention allows the brake frame 125 to pivot on any hinge with any type of wheel without deviating from the scope of the invention.

FIG. 7 is an illustration of a side view of one embodiment of the skate brake assembly and shows the primary tension member as a bendable, semi-rigid or rigid but inelastic strap, straight or shaped, wherein the first end of the primary tension member attaches to the skate frame. As shown in FIG. 7, another embodiment of the skate brake assembly 200 preferably includes: a skate 205; primary tension member 210; cuff 215; compression member 220; brake frame 225; pivot 230; brake pad 235; second tension member 240; and an attachment point 250. The skate 205 preferably includes a skate shoe 203; a skate frame 206; and one or more skate wheels 207. In this embodiment, the first end 255 of the primary tension member 210, which is preferably a bendable semi-rigid or rigid, straight or shaped, but inelastic strap, may be moveably attached, connected, or otherwise aligned to the skate 205 by connecting the first end 255 of the primary tension member 210 to the skate frame 206. This may be accomplished by adding a pivot, hinge, rod, loop, or the like to the skate frame 206 and moveably connecting the first end 255 of the primary tension member 210 to the skate frame 206. This may also be accomplished by moveably connecting the first end 255 of the primary tension member 210 to an existing feature of the skate frame 206. FIG. 7 also shows the second end 260 of the primary tension member 210 as being preferably connected to the top of the compression member, or to the cuff 215. As discussed above, the length of the primary tension member 210 may adjusted by utilizing adjustment holes, locks, sliders, or the like, such that the point of engagement of the brake pad 235 with the ground changes in accordance with the user's preferences. The user may also configure the compression member to be any length, width, or height, in accordance with the user's preferences. Although FIG. 7 shows the first end 255 of the primary tension member 210 as moveably attached or connected to approximately the mid-rear section of the skate frame 206, it should be understood that the primary tension member may be attached at any location on the skate frame 206. It should also be understood that more than one primary tension member 210 may be included such as two primary tension members for each side of the skate. The engagement point of the brake pad, to the users' preference, may also be adjusted or manipulated by adding or taking away padding in the cuff 215. Specifically, this allows for easy, fine tuning of the brake engagement point. In the embodiment in FIG. 7, the primary tension member is preferably not connected at all to the skate shoe 203.

FIG. 8 is an illustration of a side view of one embodiment of the skate brake assembly and shows the primary tension member as a bendable, semi-rigid or rigid but inelastic, but inelastic strap, straight or shaped, wherein the first end of the primary tension member attaches to the skate shoe. As shown in FIG. 8, another embodiment of the skate brake assembly 300 preferably includes: a skate 305; primary tension member 310; cuff 315; compression member 320; brake frame 325; pivot 330; brake pad 335; second tension member 340; and an attachment point 350. The skate 305 preferably includes a skate shoe 303; a skate frame 306; and one or more skate wheels 307. In this embodiment, the first end 355 of the primary tension member 310, which is preferably a bendable semi-rigid or rigid, straight or shaped, but inelastic strap, may be moveably attached, connected, or otherwise aligned to the skate 305 by connecting the first end 355 of the primary tension member 310 to the skate shoe 303. This may be accomplished by adding a pivot, hinge, rod, loop, or the like on the skate shoe 303 and moveably connecting the first end 355 of the primary tension member 310 to the skate shoe 303. This may also be accomplished by moveably connecting the first end 355 of the primary tension member 310 to an existing feature of the skate shoe 303. FIG. 8 also shows the second end 360 of the primary tension member 310 as being preferably connected to the top of the compression member 320, or to the cuff 315. As discussed above, the length of the primary tension member 310 may adjusted by utilizing adjustment holes, locks, sliders, or the like, such that the point of engagement of the brake pad 335 with the ground changes in accordance with the user's preferences. The user may also configure the compression member to be any length, width, or height, in accordance with the user's preferences. In this embodiment, the primary tension member 310 may also be adjusted by utilizing adjustment holes. Although FIG. 8 shows the first end 355 of the primary tension member 310 as moveably attached or connected to the approximately the mid-section of the skate shoe 303, it should be understood that the primary tension member 310 may be attached at any location on the skate shoe 303. It should also be understood that more than one primary tension member 310 may be included such as two primary tension members for each side of the skate. The engagement point of the brake pad, to the users' preference, may also be adjusted or manipulated by adding or taking away padding in the cuff 315. Specifically, this allows for easy, fine tuning of the brake engagement point. In the embodiment in FIG. 8, the primary tension member is preferably not connected at all to the skate frame 306.

Figure 9:
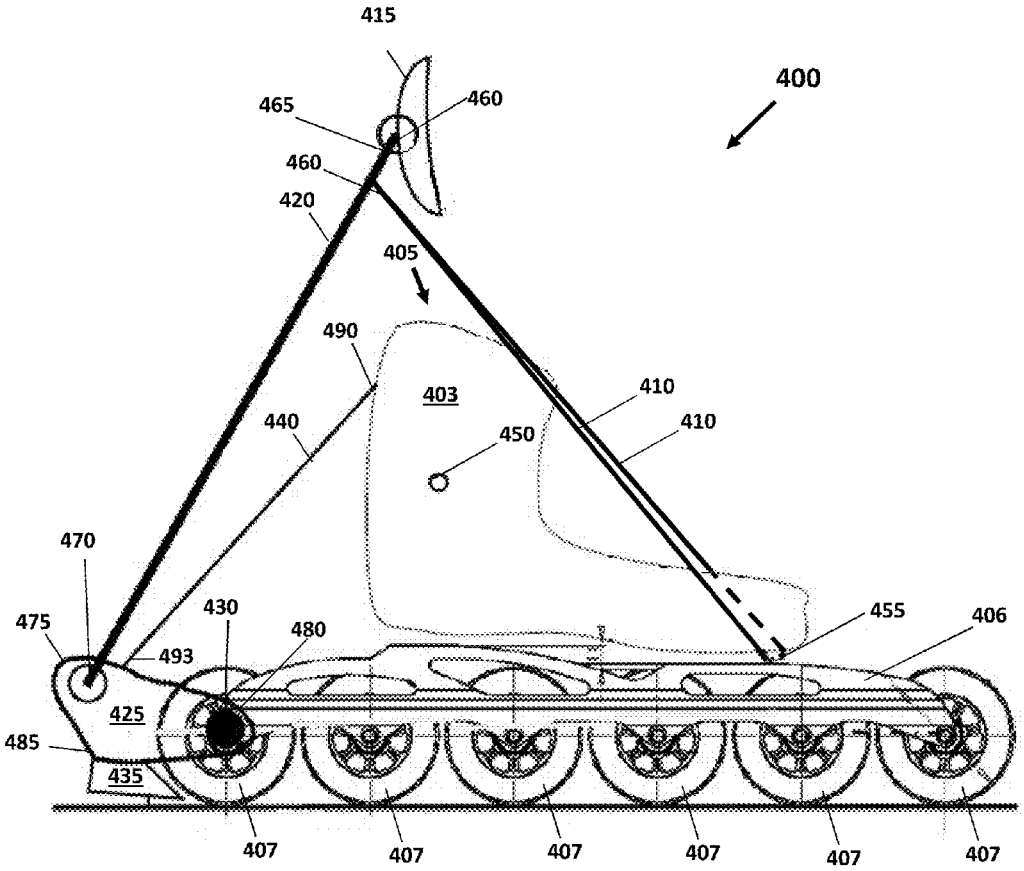
FIG. 9 is an illustration of a side view of one embodiment of the skate brake assembly and shows the second end of the primary tension member attached to the compression member.

FIG. 9 is an illustration of a side view of one embodiment of the skate brake assembly and shows the second end of the primary tension member attached to the compression member. As shown in FIG. 9, another embodiment of the skate brake assembly 400 preferably includes: a skate 405; primary tension member 410; cuff 415; compression member 420; brake frame 425; pivot 430; brake pad 435; second tension member 440; and an attachment point 450. The skate 405 preferably includes a skate shoe 403; a skate frame 406; and one or more skate wheels 407. In this embodiment, the first end 455 of the primary tension member 410, which is preferably a bendable semi-rigid or rigid, straight or shaped, but inelastic strap, may be moveably attached, connected, or otherwise aligned to the skate 405 by connecting the first end 455 of the primary tension member 410 to the skate shoe 403. This may be accomplished by adding a pivot, hinge, rod, loop, or the like on the skate shoe 403 and moveably connecting the first end 455 of the primary tension member 410 to the skate shoe 403. This may also be accomplished by moveably connecting the first end 455 of the primary tension member 410 to an existing feature of the skate shoe 403. FIG. 9 also shows the second end 460 of the primary tension member 410 as being preferably connected to an upper portion of the compression member 420. As discussed above, the length of the primary tension member 410 may adjusted by utilizing adjustment holes, locks, sliders, or the like, such that the point of engagement of the brake pad 435 with the ground changes in accordance with the user's preferences. The user may also configure the compression member to be any length, width, or height, in accordance with the user's preferences. Although FIG. 9 shows the first end 455 of the primary tension member 410 as moveably attached or connected to the approximately the front portion of the skate shoe 403, it should be understood that the primary tension member 410 may be attached at any location on the skate shoe 403 or skate frame 406. It should also be understood that more than one primary tension member 410 may be included such as two primary tension members for each side of the skate. The engagement point of the brake pad, to the users' preference, may also be adjusted or manipulated by adding or taking away padding in the cuff 415. Specifically, this allows for easy, fine tuning of the brake engagement point.

Figure 10:
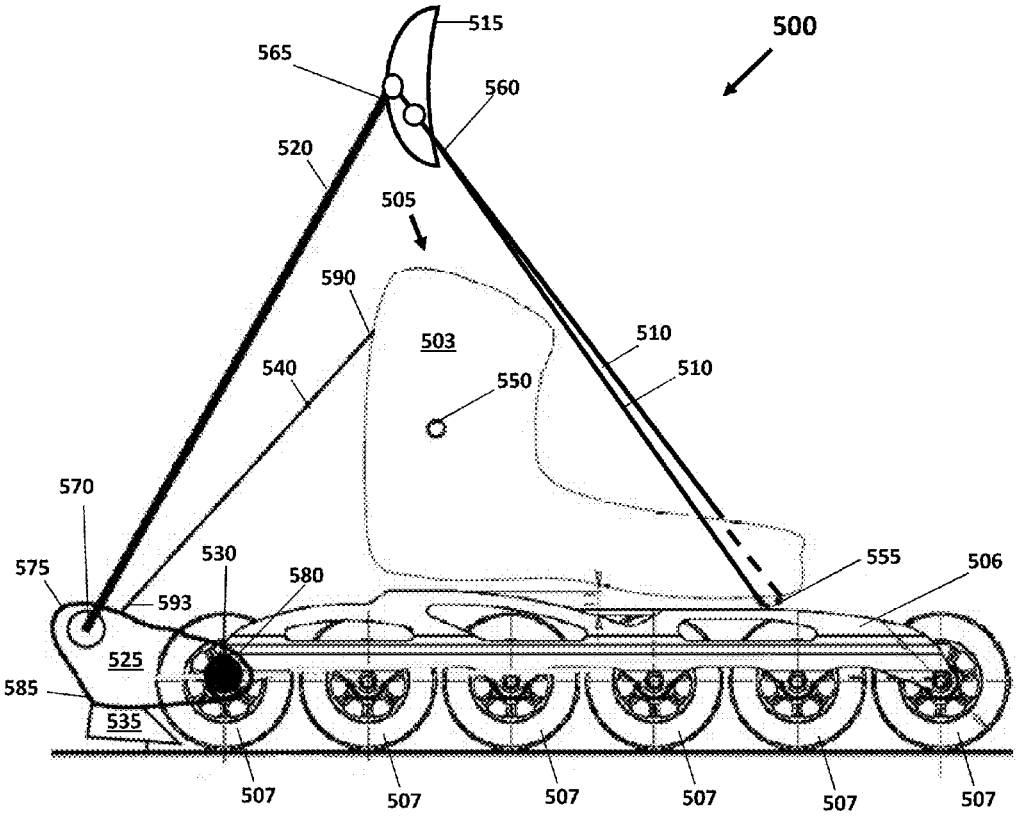
FIG. 10 is an illustration of a side view of one embodiment of the skate brake assembly and shows the second end of the primary tension member attached to the compression member and then to the cuff while the cuff is attached to both the compression member and primary tension member.

FIG. 10 is an illustration of a side view of one embodiment of the skate brake assembly and shows the second end of the primary tension member attached to the compression member and then to the cuff while the cuff is attached to both the compression member and primary tension member. As shown in FIG. 10, another embodiment of the skate brake assembly 500 preferably includes: a skate 505; primary tension member 510; cuff 515; compression member 520; brake frame 525; pivot 530; brake pad 535; second tension member 540; and an attachment point 550. The skate 505 preferably includes a skate shoe 503; a skate frame 506; and one or more skate wheels 507. In this embodiment, the first end 555 of the primary tension member 510, which is preferably a bendable semi-rigid or rigid, straight or shaped, but inelastic strap, may be moveably attached, connected, or otherwise aligned to the skate 505 by connecting the first end 555 of the primary tension member 510 to the skate shoe 503. This may be accomplished by adding a pivot, hinge, rod, loop, or the like on the skate shoe 503 and moveably connecting the first end 555 of the primary tension member 510 to the skate shoe 503. This may also be accomplished by moveably connecting the first end 555 of the primary tension member 510 to an existing feature of the skate shoe 503. FIG. 10 also shows the second end 560 of the primary tension member 510 as being preferably connected to an upper portion of the compression member 520 with another portion of the primary tension member being connected to the cuff 515. Specifically, while the second end 560 of the primary tension member 510 is preferably connected to the upper portion of the compression member 520, any portion of the primary tension member such as the upper, mid, or lower portion is preferably connected to the cuff 515. Furthermore, the cuff 515 is also preferably connected to both the upper portion of the compression member 520 and second end 560 of the primary tension member 510. As discussed above, the length of the primary tension member 510 may adjusted by utilizing adjustment holes, locks, sliders, or the like, such that the point of engagement of the brake pad 535 with the ground changes in accordance with the user's preferences. The user may also configure the compression member to be any length, width, or height, in accordance with the user's preferences. Although FIG. 10 shows the first end 555 of the primary tension member 510 as moveably attached or connected to the approximately the front portion of the skate shoe 503, it should be understood that the primary tension member 510 may be attached at any location on the skate shoe 503 or skate frame 506. It should also be understood that more than one primary tension member 510 may be included such as two primary tension members for each side of the skate. The engagement point of the brake pad, to the users' preference, may also be adjusted or manipulated by adding or taking away padding in the cuff 515. Specifically, this allows for easy, fine tuning of the brake engagement point.

Figure 11:
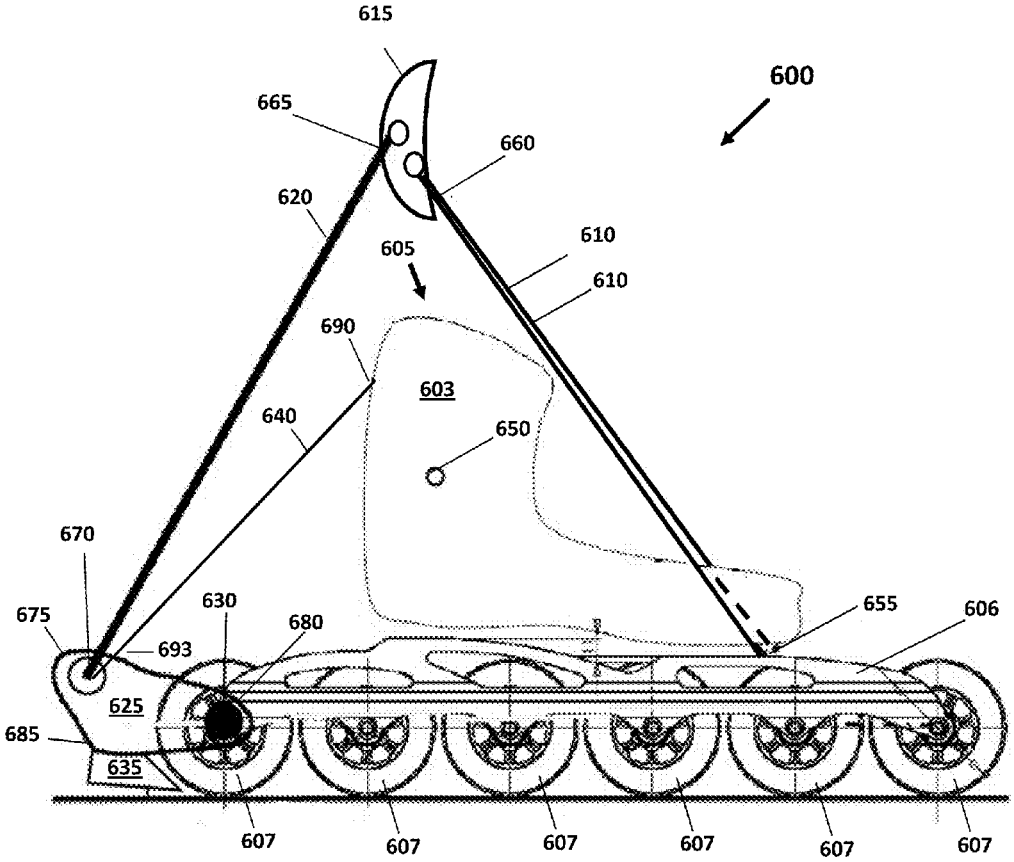
FIG. 11 is an illustration of a side view of one embodiment of the skate brake assembly and shows the second end of the second tension member attached to the lower end of the compression member; the second end of the primary tension member connected only to the cuff; and the upper end of the compression member connected only to the cuff.

FIG. 11 is an illustration of a side view of one embodiment of the skate brake assembly and shows the second end of the second tension member attached to the lower end of the compression member; the second end of the primary tension member connected only to the cuff; and the upper end of the compression member connected only to the cuff. As shown in FIG. 11, another embodiment of the skate brake assembly 600 preferably includes: a skate 605; primary tension member 610; cuff 615; compression member 620; brake frame 625; pivot 630; brake pad 635; second tension member 640; and an attachment point 650. The skate 605 preferably includes a skate shoe 603; a skate frame 606; and one or more skate wheels 607. In this embodiment, the first end 690 of the second tension member 640, which is preferably an elastic material that returns to its original shape, is preferably connected to a rear, upper portion of the skate shoe 603. Additionally, the second end 693 of the second tension member 640 is preferably connected to lower end 670 of the compression member 620. Although FIG. 11 shows the second tension member 640 connected to the skate 605 and compression member 620, it should be understood that the present invention allows the second tension member 640 to be connected to other parts of the skate 605 without deviating from the scope of the invention (see examples in FIG. 3).

FIG. 11 also shows the second end 660 of the primary tension member 610 connected only to the cuff 615 and the upper end 665 of the compression member 620 connected only to the cuff 615. Specifically, when the second end 660 of the primary tension member 660 and the upper end 665 of the compression member 620 are preferably connected to cuff 615, the primary tension member 610 and compression member 620 may be separated, such that the cuff 615 preferably acts as a bridge between the compression member 620 and primary tension member 660. This configuration preferably causes the cuff 615 to take the cumulative load from the user's leg, pull from the primary tension member 610, and upward resisting force from the compression member 620.

Unless otherwise stated, all measurements, values, ratings, positions, magnitudes, sizes, locations, and other specifications which are set forth in this specification, including in the claims which follow, are approximate, not exact. They are intended to have a reasonable range which is consistent with the functions to which they relate and with what is customary in the art to which they pertain.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A skate brake assembly, comprising:
one or more primary tension members;
one or more second tension members;
a cuff;
one or more compression members;
a brake frame; and
a brake pad;
wherein a first end of said one or more primary tension members are configured to be attached to a skate;
wherein a second end of said one or more primary tension members are attached to said cuff;
wherein said cuff is configured to be aligned to a leg of a user, such that when said leg pushes rearward, said cuff is also pushed rearward;
wherein an upper end of said one or more compression members is attached to said cuff;
wherein a lower end of said one or more compression members is attached to said brake frame;
wherein said brake frame is configured to be connected to said skate;
wherein said brake pad is attached to said brake frame;
wherein said brake pad is configured to contact one or more surfaces being skated on;
wherein, as said leg of said user pushes rearward, said cuff pushes said one or more compression members rearward;
wherein, as said one or more compression members is pushed rearward, said one or more primary tension members constrain said backward motion of said one or more compression members, such that said one or more compression members is pushed substantially downward;
wherein, as said one or more compression members is pushed substantially downward, said brake frame is pushed downward, such that said brake pad contacts said one or more surfaces being skated on;
wherein a first end of said one or more second tension members are configured to be attached to said skate;
wherein a second end of said one or more second tension members are attached to said brake frame; and
wherein said one or more second tension members are configured to hold said brake frame in a neutral position, such that said brake pad is not in contact with said one or more surfaces being skated on when said leg is not pushed backwards.

2. The skate brake assembly according to claim 1, further comprising:
one or more third tension members;
wherein a first end of said one or more third tension members are connected to said one or more primary tension members and a second end of said one or more third tension members are configured to be connected to said skate, such that said one or more third tension members substantially aligns said one or more primary tension members.

3. The skate brake assembly according to claim 2, wherein said brake frame rotatably attaches to a pivot, such that when said one or more compression members pushes downwards, said brake frame pivots downwards, and when said one or more compression members is not pushing down, said brake frame pivots to said neutral position.

4. The skate brake assembly according to claim 3, wherein a length of said one or more primary tension members are adjustable, such that a movement where said rearward pushing of said calf causes said brake pad to contact said one or more surfaces can be adjusted to a preference of said user and as said brake pad wears down with use.

5. The skate brake assembly according to claim 3, wherein a length of said one or more compression members is adjustable.

6. The skate brake assembly according to claim 5, wherein said length of said one or more compression members is adjustable, such that a movement where said rearward pushing of said calf causes said brake pad to contact said one or more surfaces can be adjusted to a preference of said user and as said brake pad wears down with use.

7. The skate brake assembly according to claim 5, wherein said skate brake assembly is configured to a stowed position;

wherein said stowed position occurs when said brake frame pivots upwards, such that said brake pad is substantially away from said one or more surfaces.

8. The skate brake assembly according to claim 7, wherein said leg of said user is a calf.

9. The skate brake assembly according to claim 8, wherein said brake frame is adjustable to one or more wheel sizes, such that said user may reposition said pivot at one or more hinge points of said brake frame.

10. The skate brake assembly according to claim 9, wherein said brake frame is adjustable to one or more braking forces, such that said user may reposition said lower end of said one or more compression members to one or more connections points of said brake frame.

11. The skate brake assembly according to claim 1, further comprising:

one or more second tension members;

wherein a first end of said one or more second tension members are configured to be attached to said skate;

wherein a second end of said one or more second tension members are attached to said lower end of said one or more compression members; and wherein said one or more second tension members are configured to hold said brake frame in a neutral position, such that said brake pad is not in contact with said one or more surfaces being skated on when said leg is not pushed backwards.

12. A skate brake assembly, comprising:

one or more primary tension members;

one or more second tension members;

a cuff;

one or more compression members;

a brake frame; and a brake pad;

wherein a first end of said one or more primary tension members are configured to be attached to a skate;

wherein a second end of said one or more primary tension members are attached to said cuff;

wherein said cuff is configured to be attached to a calf of a user, such that when said calf pushes rearward, said cuff is also pushed rearward;

wherein an upper end of said one or more compression members is attached to said cuff;

wherein a lower end of said one or more compression members is attached to said brake frame;

wherein said brake frame is configured to be connected to said skate;

wherein said brake pad is attached to said brake frame;

wherein said brake pad is configured to contact one or more surfaces being skated on;

wherein, as said calf of said user pushes rearward, said cuff pushes said one or more compression members rearward;

wherein, as said one or more compression members is pushed rearward, said one or more primary tension members constrain said backward motion of said one or more compression members, such that said one or more compression members is pushed substantially downward;

wherein, as said one or more compression members is pushed substantially downward, said brake frame is pushed downward, such that said brake pad contacts said one or more surfaces being skated on;

wherein a first end of said one or more second tension members are configured to be attached to said skate;

wherein a second end of said one or more second tension members are attached to said brake frame; and wherein said one or more second tension members are configured to hold said brake frame in a neutral position, such that said brake pad is not in contact with said one or more surfaces being skated on when said calf is not pushed backwards.

13. The skate brake assembly according to claim 12, further comprising:

one or more third tension members;

wherein a first end of said one or more third tension members are connected to said one or more primary tension members and a second end of said one or more third tension members are configured to be connected to said skate, such that said one or more third tension members substantially aligns said one or more primary tension members.

14. The skate brake assembly according to claim 13, wherein said brake frame rotatably attaches to a pivot, such that when said one or more compression members pushes downwards, said brake frame pivots downwards, and when said one or more compression members is not pushing down, said brake frame pivots to said neutral position.

15. The skate brake assembly according to claim 14, wherein said skate brake assembly is configured to a stowed position;

wherein said stowed position occurs when said brake frame pivots upwards, such that said brake pad is substantially away from said one or more surfaces.

16. The skate brake assembly according to claim 15, wherein said brake frame is adjustable to one or more wheel sizes, such that said user may reposition said pivot at one or more hinge points of said brake frame.

17. The skate brake assembly according to claim 16, wherein said brake frame is adjustable to one or more braking forces, such that said user may reposition said lower end of said one or more compression members to one or more connections points of said brake frame.

18. The skate brake assembly according to claim 17, wherein a length of said one or more compression members is adjustable.

19. A skate brake assembly, comprising:

one or more primary tension members;

a cuff;

one or more compression members;

a brake frame;

a brake pad;

wherein a first end of said one or more primary tension members are configured to be attached to a skate;

wherein a second end of said one or more primary tension members are attached to an upper portion of said skate brake assembly, such that said second end of one or more primary tension members is behind a calf of a user;

wherein said cuff is configured to be attached to said calf of said user, such that when said calf pushes rearward, said cuff is also pushed rearward;

wherein an upper end of said one or more compression members is attached to said cuff;

wherein a lower end of said one or more compression members is attached to said brake frame;

wherein said brake frame is configured to be moveably connected to said skate;

wherein said brake pad is attached to said brake frame;

wherein said brake pad is configured to contact one or more surfaces being skated on;

wherein, as said calf of said user pushes rearward, said cuff pushes said one or more compression members rearward;

wherein, as said one or more compression members is pushed rearward, said one or more primary tension members constrain said backward motion of said one or more compression members, such that said one or more compression members is pushed substantially downward; and wherein, as said one or more compression members is pushed substantially downward, said brake frame is pushed downward, such that said brake pad contacts said one or more surfaces being skated on.

20. The skate brake assembly according to claim 19, wherein said second end of said one or more primary tension members are attached to said upper end of said one or more compression members.

21. The skate brake assembly according to claim 19, wherein said second end of said one or more primary tension members are attached to said upper end of said one or more compression members; and wherein a portion of said one or more primary tension members are attached to said cuff.

22. The skate brake assembly according to claim 19, wherein said second end of said one or more primary tension members are attached to said cuff;

wherein said upper end of said one or more compression members is attached to said cuff; and wherein said one or more primary tension members and said one or more compression members are separate.

* * * * *